US005215031A

United States Patent [19]

Inman et al.

[11] Patent Number: 5,215,031

[45] Date of Patent: Jun. 1, 1993

[54] PROTECT A BOAT

[76] Inventors: Arthur M. Inman, 1520 Rushmore Ave. S.E., Palm Bay, Fla. 32909; George Spector, 233 Broadway Rm. 3815, New York, N.Y. 10007

[21] Appl. No.: 767,872

[22] Filed: Sep. 30, 1991

[51] Int. Cl.[5] ..... B63B 43/14

[52] U.S. Cl. ..... 114/360; 114/68; 114/219

[58] Field of Search ..... 114/219, 360, 68, 69, 114/123, 345

[56] References Cited

U.S. PATENT DOCUMENTS

| | | | |
|---|---|---|---|
| 1,220,876 | 3/1917 | Moore | 114/360 |
| 1,620,867 | 3/1927 | Boyle | 114/345 |
| 2,848,725 | 8/1958 | Sloulin | 114/219 |
| 3,121,888 | 2/1964 | Morgan et al. | 114/219 |
| 4,520,746 | 6/1985 | Walters et al. | 114/123 |
| 4,945,851 | 8/1990 | Buckle | 114/345 |
| 4,970,980 | 11/1990 | Eisner | 114/219 |

*Primary Examiner*—Sherman Basinger

[57] ABSTRACT

A protection device for a boat having a rigid hull with a waterline, gunwale and a cockpit is provided. The device consists of a first inflatable bumper mounted to the rigid hull about the gunwale, which will absorb impacts to the hull when the boat is pulled next to a dock or the like. A second inflatable bumper is mounted to the rigid hull at the waterline to keep the rigid hull afloat if it becomes cracked. A mechanism is in the cockpit, for selectively inflating the first inflatable bumper and the second inflatable bumper.

1 Claim, 1 Drawing Sheet

PROTECT A BOAT

BACKGROUND OF THE INVENTION

The instant invention relates generally to boats and more specifically it relates to a protection device for a boat which provides inflatable bumpers to absorb impacts and keep the boat from sinking.

There are available various conventional boats which do not provide the novel improvements of the invention herein disclosed.

SUMMARY OF THE INVENTION

A primary object of the present invention is to provide a protection device for a boat that will overcome the shortcomings of the prior art devices.

Another object is to provide a protection device for a boat that includes a pair of inflatable bumpers which will absorb impacts to the hull and keep the boat from sinking if the hull becomes cracked.

An additional object is to provide a protection device for a boat in which the top bumper will cushion the hull when the boat is pulled next to a dock and the bottom bumper will keep the hull afloat at the water line of flotation.

A further object is to provide a protection device for a boat that is simple and easy to use.

A still further object is to provide a protection device for a boat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
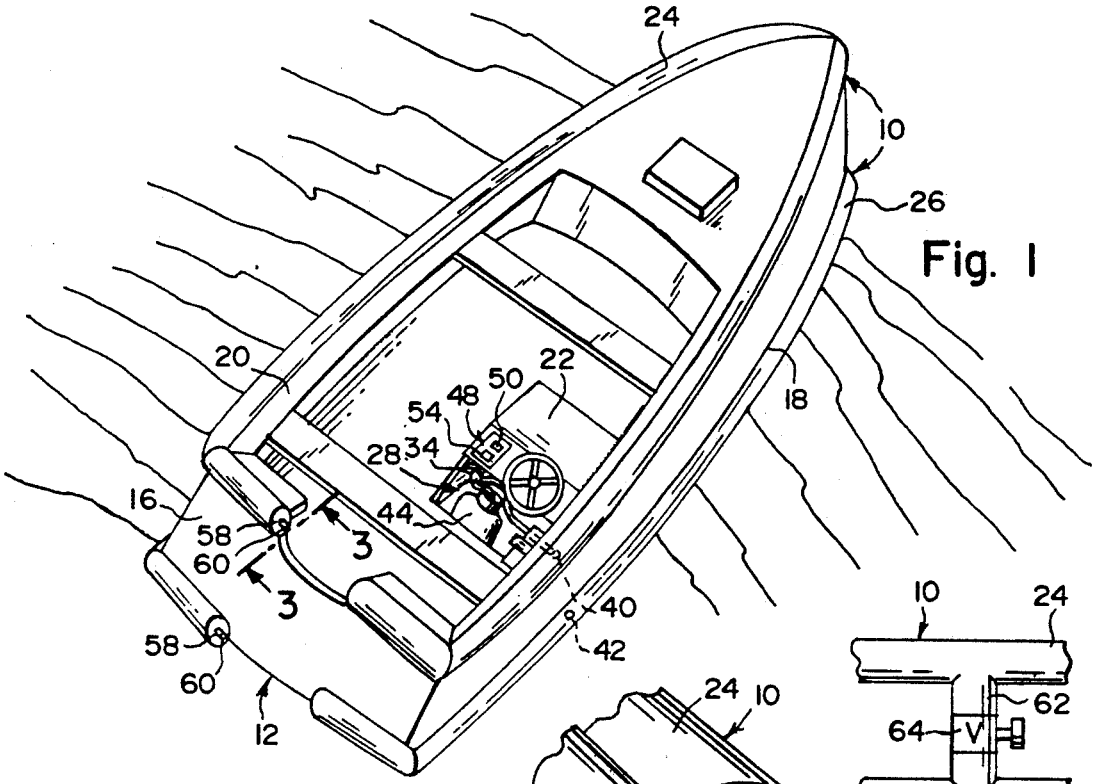
FIG. 1 is a perspective view of a boat with the instant invention installed thereon.

Turning now descriptively to the drawings, in which similar reference characters denote similar elements throughout the several views, the Figures illustrate a protection device 10 for a boat 12 having a rigid hull 16 with a waterline 18, a gunwale 20, and a cockpit 22. The device 10 consists of a first inflatable bumper 24 mounted to the rigid hull 16 about the gunwale 20, which will absorb impacts to the hull 16 when the boat 12 is pulled next to a dock or the like. A second inflatable bumper 26 is mounted to the rigid hull 16 at the waterline 18 to keep the rigid hull 16 afloat if it becomes cracked. A mechanism 28 is in the cockpit for selectively inflating the first inflatable bumper 24 and the second inflatable bumper 26.

The first inflatable bumper 24 and the second inflatable bumper 26 each have a stiffener member 30 thereon. A pair of C-shaped in cross section brackets 32 are each affixed to the rigid hull 16 by fasteners (not shown), so as to hold each stiffener member 30 thereon.

The selectively inflating mechanism 28 includes a solenoid valve 34 separately fluidly connected to the first inflatable bumper 24 and the second inflatable bumper 26 via air lines 36 and 38 to air intake valves 40 and 42. A compressed air tank 44 is fluidly connected via airline 46 to the solenoid valve 34. A switch panel 48 has a first switch 50 electrically connected via wire 52 to the solenoid valve 34 and a second switch 54 electrically connected via wire 56 to the solenoid valve 34. When the first switch 50 is activated the solenoid valve 34 will allow the compressed air tank 44 to fill the first inflatable bumper 24. When the second switch 54 is activated the solenoid valve 34 will allow the compressed air tank 44 to fill the second inflatable bumper 26.

The first inflatable bumper 24 and the second inflatable bumper 26 each include a release valve 58, fluidly connected thereto. A cap 60 threadably engages the release valve 58 so that when the cap 60 is removed the release valve 58 can be activated to allow the compressed air to evacuate therefrom.

Figure 4:
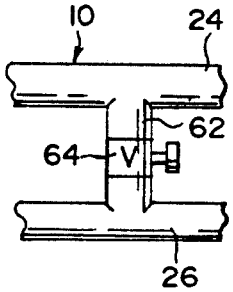
FIG. 4 is another modification showing an intercommunicating duct between the bumpers with a cut off valve.
Figure 2:
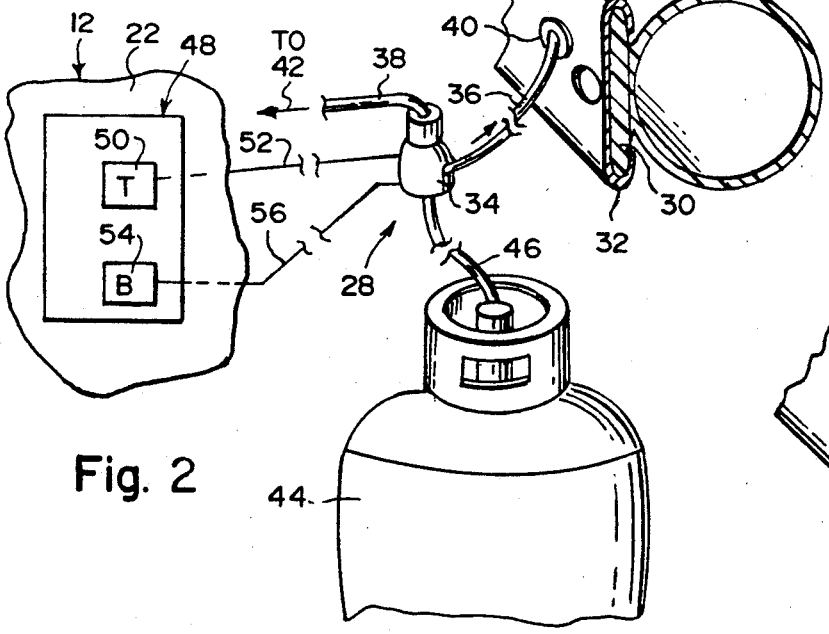
FIG. 2 is a perspective view with parts broken away of the various components of the invention.
Figure 3:
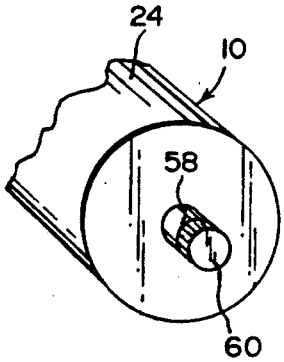
FIG. 3 is a perspective view taken in direction of 3—3 in FIG. 1, showing the release valve and cap in greater detail.

As shown in FIG. 4, the protection device 10 further includes an intercommunicating duct 62 between the bumpers 24 and 26. A cut-off valve 64 is in the duct 62 for manually closing off the fluid communication between the bumpers 24 and 26 if there is fluid leakage from either bumper.

The solenoid valve 34 has four positions controlled by switches 50 and 54:

1. No air flow;
2. Air flow only to the first bumper 24;
3. Air flow only to the second bumper 26; and
4. Air flow to both bumpers 24 and 26.

The second bumper 26 is to be inflated only in case of an emergency to keep the boat 12 afloat. The second bumper 26 should also have a cover to protect it from damage, which will be able to be blown off when inflated. Two bumpers 24 and 26 are typically shown in the drawings, but additional bumpers can be utilized for better protection to the boat 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A protection device for a boat having a rigid hull with a waterline, a gunwale, and a cockpit, said device comprising:

a) a first inflatable bumper mounted to the rigid hull about the gunwale, which will absorb impacts to the hull when the boat is pulled next to a dock or the like;

b) a second inflatable bumper mounted to the rigid hull at the waterline to keep the rigid hull afloat if it becomes cracked;

c) means in the cockpit for selectively inflating said first inflatable bumper and said second inflatable bumper, further including:

d) said first inflatable bumper and said second inflatable bumper, each having a stiffener member thereon;

e) a pair of C-shaped in cross section brackets, each affixed to the rigid hull so as to hold each said stiffener member therein, wherein said selectively inflating means includes:

f) a solenoid valve separately fluidly connected to said first inflatable bumper and said second inflatable bumper;

g) a compressed air tank fluidly connected to said solenoid valve;

h) a switch panel having a first switch electrically connected to said solenoid valve and a second switch electrically connected to said solenoid valve so that when said first switch is activated said solenoid valve will allow said compressed air tank to fill said first inflatable bumper and when said second switch is activated said solenoid valve will allow said compressed air tank to fill said second inflatable bumper; wherein said first inflatable bumper and said second inflatable bumper each include:

i) a release valve fluidly connected thereto;

j) a cap that threadably engages said release valve so that when said cap is removed said release valve can be activated to allow the compressed air to evacuate therefrom, further including:

K) an intercommunicating duct between said bumpers; and l) a cut-off valve in said duct for manually closing off the fluid communication between said bumpers if there is fluid leakage from either said bumper.

* * * * *